US006342857B1

(12) United States Patent
Lane

(10) Patent No.: US 6,342,857 B1
(45) Date of Patent: Jan. 29, 2002

(54) BROADBAND CIRCUIT SHORTED RESONANT PATCH ANTENNA

(75) Inventor: Alan Lane, Taipei (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/654,046

(22) Filed: Sep. 1, 2000

(51) Int. Cl.[7] ..... H01Q 1/38
(52) U.S. Cl. ..... 343/700 MS
(58) Field of Search ..... 343/700 MS; H01Q 1/38

(56) References Cited

U.S. PATENT DOCUMENTS 4,040,060 A * 8/1977 Kaloi ..... 343/700 MS
4,259,670 A * 3/1981 Schiavone ..... 343/700 MS
5,767,810 A * 6/1998 Hagiwara et al. .... 343/700 MS

* cited by examiner

*Primary Examiner*—Michael C. Wimer
(74) *Attorney, Agent, or Firm*—Troxell Law Offices PLLC

(57) ABSTRACT

A broadband circuit shorted resonant patch antenna, it is provided with an open circuit end and a short circuit end; the open circuit end has open slots of which an electric field radiates. Path of electric current of the circuit shorted resonant patch antenna from the open circuit end to the short circuit end is extended to lower the resonance frequency, and a compensating device is used to perform broadband compensation to maintain the bandwidth in use. The short circuit end can be partially shorted to extend the path of electric current. The broadband compensation can be done with a resonance circuit or a transmission line. Thereby, length of the circuit shorted resonant patch antenna can be shortened to form a miniaturized patch antenna.

5 Claims, 7 Drawing Sheets

BROADBAND CIRCUIT SHORTED RESONANT PATCH ANTENNA

BACKGROUND OF THE INVENTION

1. Field of the Invention

The present invention is related to a broadband circuit shorted resonant patch antenna, and especially to a patch antenna for which a resonant circuit is used to compensate its available frequency under the situation that the set length of the patch antenna is shortened.

2. Description of the Prior Art

A patch antenna is made mainly from an extremely thin foil (such as a copper foil) and is in the form of a planar antenna; it is used such as on a movable communication instrument in lieu of a prolonged antenna. Generally, a circuit shorted resonant patch antenna radiates taking advantage of the electric field distribution on the open circuit end thereof.

As shown in FIG. 1 which shows a conventional broadband circuit shorted resonant patch antenna 10, the antenna 10 is provided with an open circuit end 11 and a short circuit end 12, and with a set transverse length "L". The open circuit end 11 is provided with open slots 13, 14 of which an electric field radiates. Basically, such a circuit shorted resonant patch antenna 10 has the best condition for radiation when the energy of electric waves resonates in the patch antenna 10.

FIGS. 2 and 3 show an electric field and a diagram of electric current distribution respectively. We can see from the drawings that, electric current strength is the largest at the open circuit end 11, and is the smallest at the short circuit end 12. In fact, the above stated electric current distribution is only a part of the resonance waves shown in FIG. 4.

Utilizing the above stated concept of resonance waves, the length "L" of the patch antenna 10 can be conveniently set as below:

$$L = \frac{0.49}{2} \times \frac{\lambda}{\sqrt{\varepsilon_r}}$$

In the formula, $\in_r$ is a dielectric constant; $\lambda$ is wavelength. An antenna of half of the wavelength long is divided into two; thereby, it shall be divided by 2. By the nature that the electric field at the center of the resonant electric current is zero, the center of the patch antenna 10 can be grounded to form a single slot radiation, and H and E planar electric fields has the formulae as below:

$$E\theta = Eo \cos \phi f(\theta,\phi)$$

$$E\phi = Eo \cos \theta \sin \phi f(\theta,\phi),$$

wherein, $$f(\theta, \phi) = \frac{\sin\left[\frac{\beta W}{2}\sin\theta\sin\phi\right]}{\frac{\beta W}{2}\sin\theta\sin\phi} \cdot \cos\left(\frac{\beta L}{2}\sin\theta\cos\phi\right)$$

Wherein, $\beta$ is a free-space phase constant.

According to the above stated conventional structure of a broadband circuit shorted resonant patch antenna, the distribution diagram of current "a" when power is turned on is shown in FIG. 5. This diagram shows that resonance of a resonance electric current of such a patch antenna is determined by the length "L" of the antenna. A conventional broadband circuit shorted resonant patch antenna has its length "L" of the antenna set according to the above listed formula, it is thereby hard to be shortened, hence the whole patch antenna can hardly be miniaturized.

SUMMARY OF THE INVENTION

The object of the present invention is to provide a broadband circuit shorted resonant patch antenna of which the length can be shortened under an identical resonance frequency.

To get the above stated object, circuit shorted resonant patch antenna of the present invention is controlled to extend the path of electric current and to determine the resonance frequency thereof. Lengthening of the path of electric current can lower the resonance frequency; thereby the length of the patch antenna can be shortened. In cooperation with the design of shortening the length of the patch antenna, a compensating device can perform broadband compensation to maintain the bandwidth in use.

In a preferred embodiment of the present invention, the above stated short circuit end can be partially shorted to extend the path of electric current. And the broadband compensating device mentioned above can form a resonance circuit with a capacitor and an inductor parallelly connected therewith.

The broadband compensating device mentioned above can further use a transmission line at the open circuit end of its neighboring patch antenna.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 7:
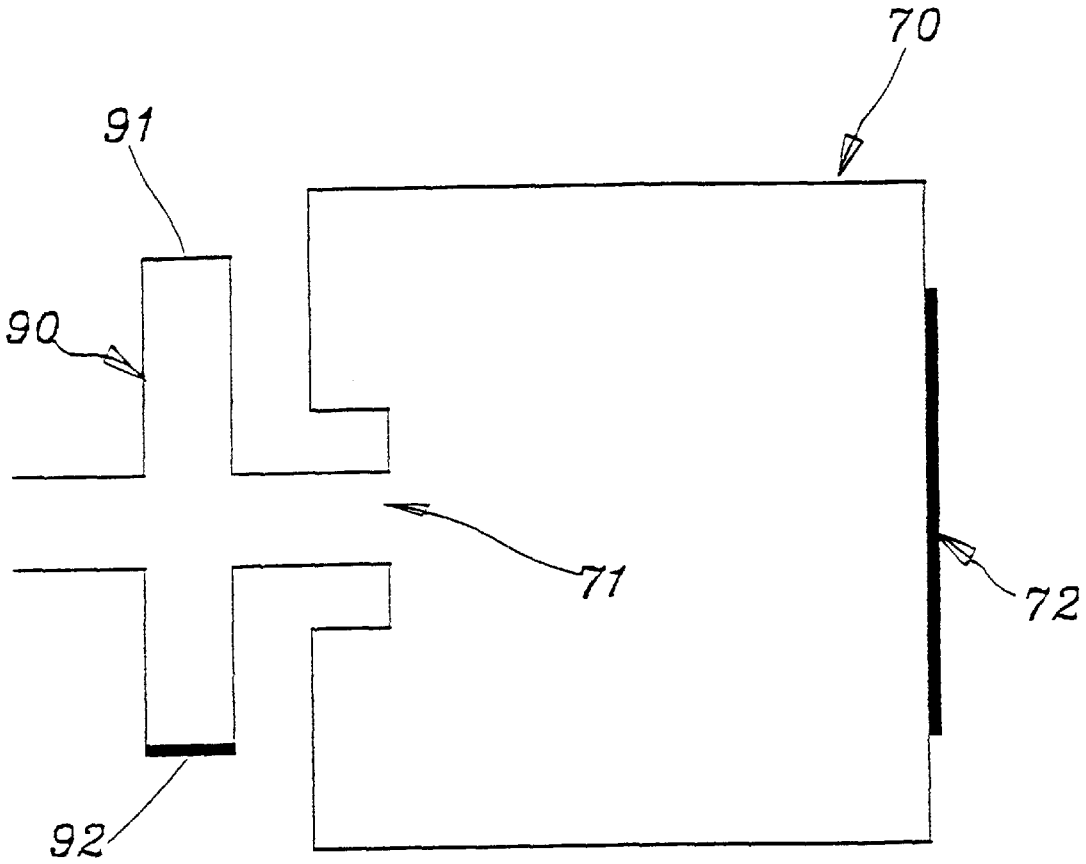
FIG. 7 is a front view showing the structure of a preferred embodiment of the present invention.
Figure 8:
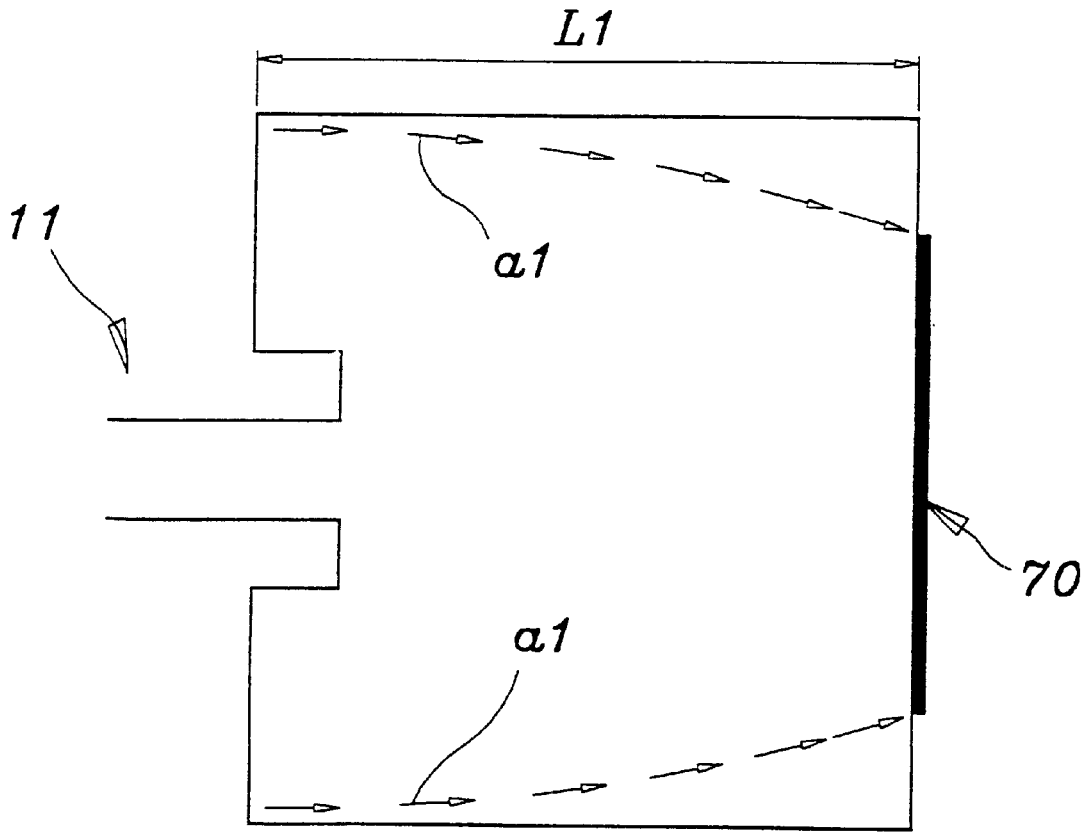
FIG. 8 is a schematic view showing flowing of electric current of FIG. 7 in a structure of which the circuit is partially shorted.

Referring to FIGS. 7, 8, the present invention has the flowing path of electric current "$a_1$" in a circuit shorted resonant patch antenna 70 extended in the first place from an open circuit end 71 to a short circuit end 72, a feasible example thereof is to make a partial shorted circuit 72. By virtue that the flowing path of electric current "$a_1$" is elongated, resonance frequency will be lowered, i.e., an identical resonance frequency will allow shortening of the length $L_1$ of the patch antenna 70.

The above stated technique has a disadvantage, namely, the bandwidth of the whole patch antenna 70 will be reduced, but this can be compensated by using a compensating device for the resonance circuit which can perform broadband compensation.

Figure 1:
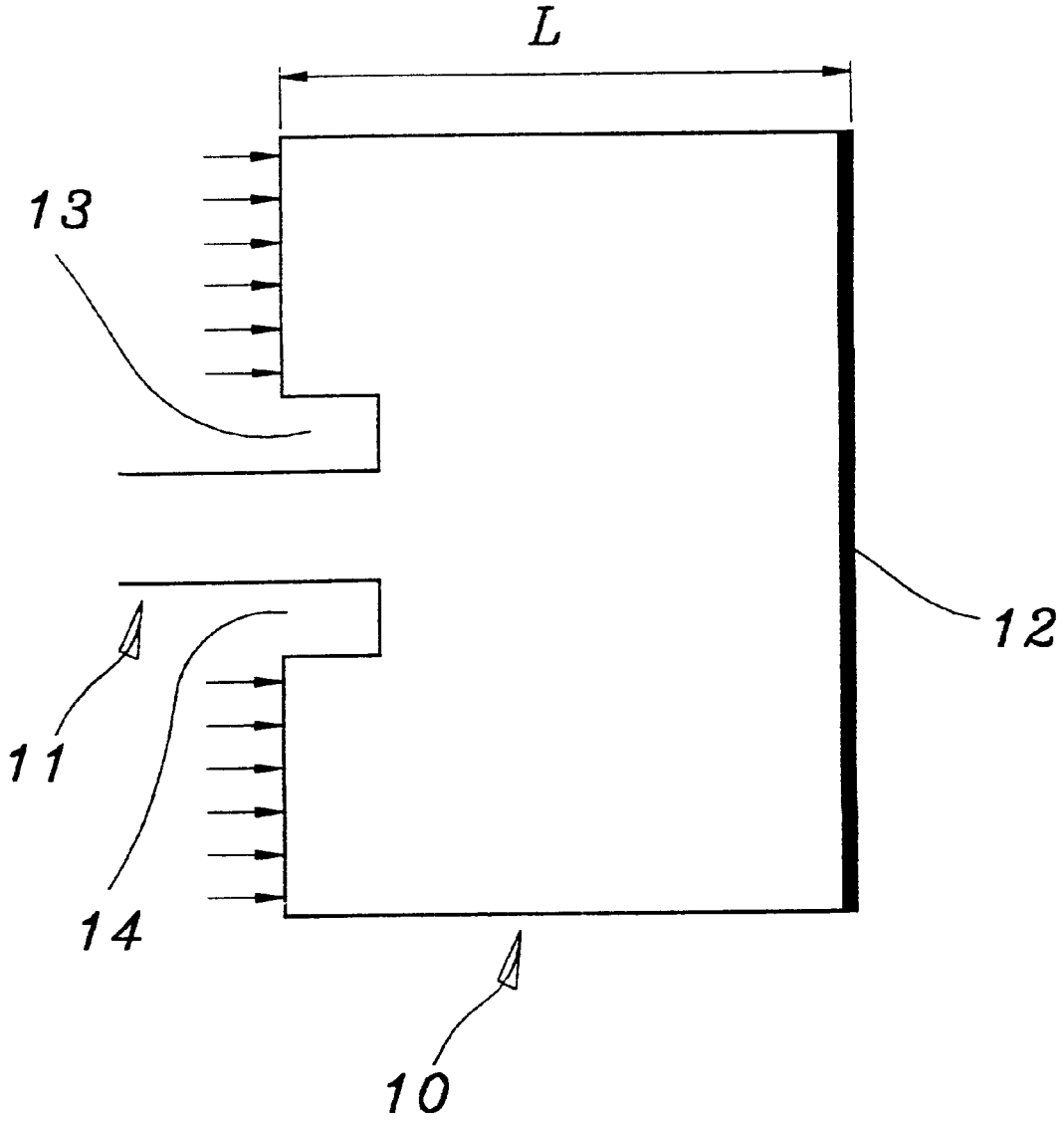
FIG. 1 PRIOR ART
FIG. 1 is a front view showing the structure of a conventional resonant patch antenna.
Figure 2:
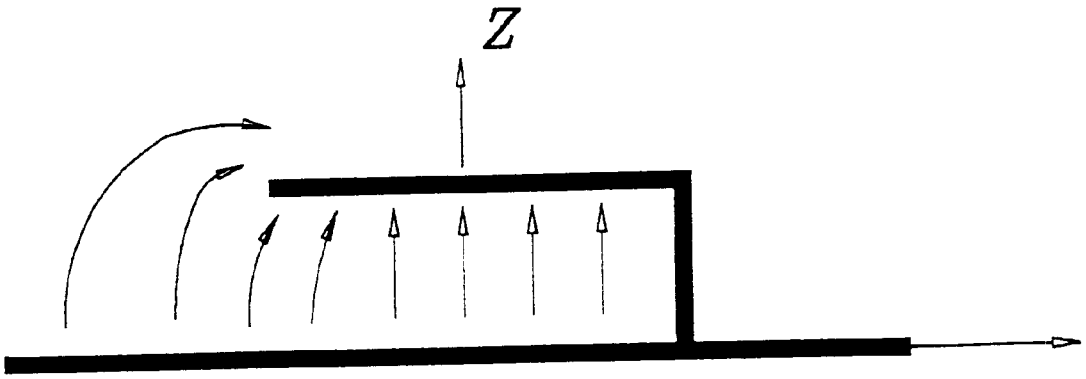
FIG. 2 PRIOR ART
FIG. 2 is a schematic view showing a distribution diagram of an electric field of FIG. 1.
Figure 3:
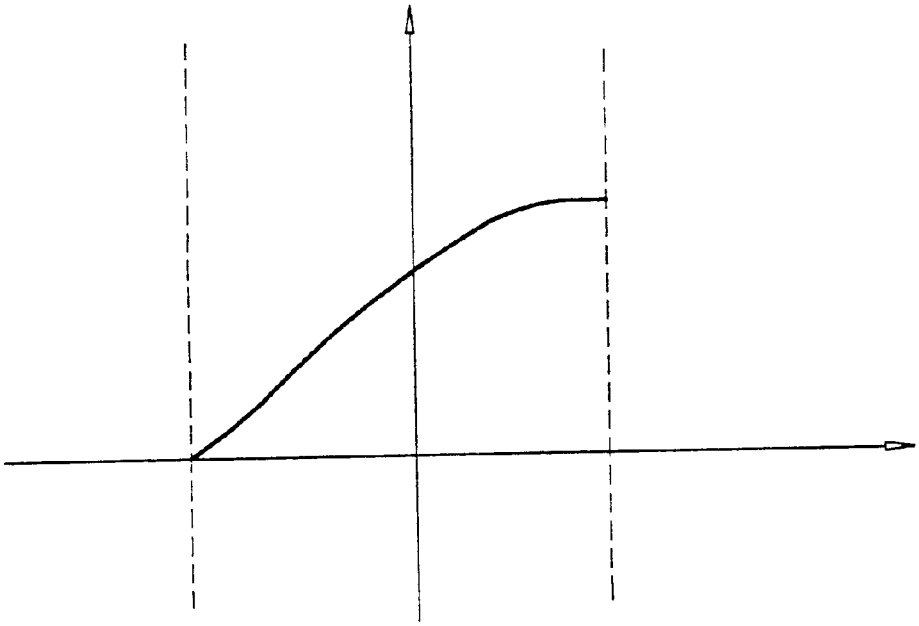
FIG. 3 PRIOR ART
FIG. 3 is a schematic view showing a distribution diagram of electric current of FIG. 1.
Figure 4:
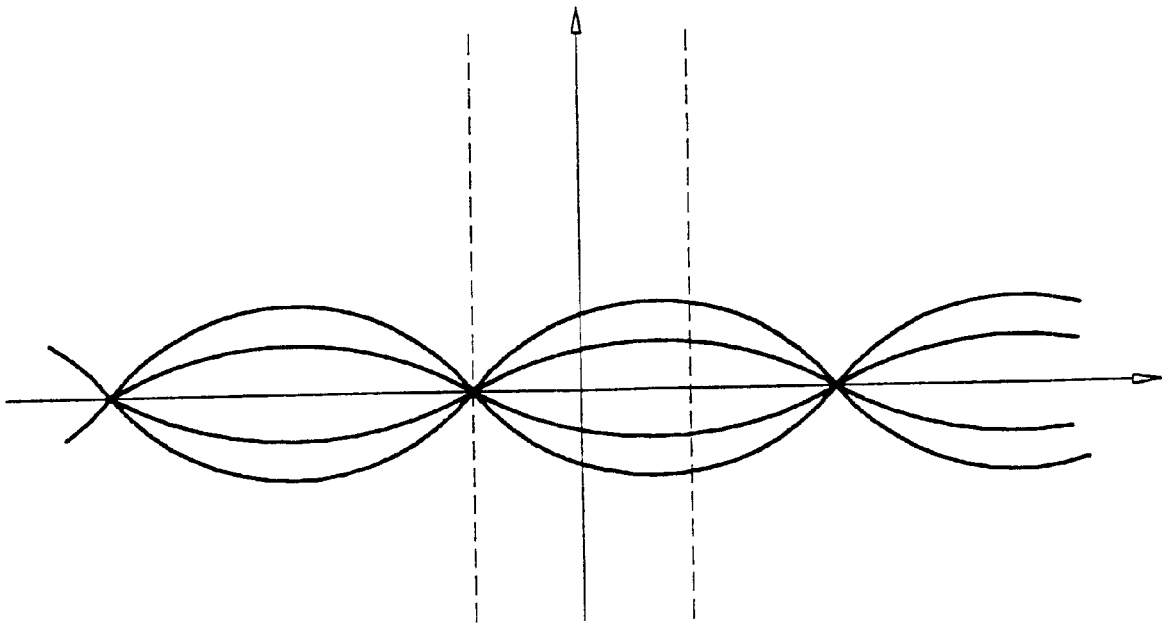
FIG. 4 PRIOR ART
FIG. 4 is a schematic view showing resonance waveforms of FIG. 1.
Figure 5:
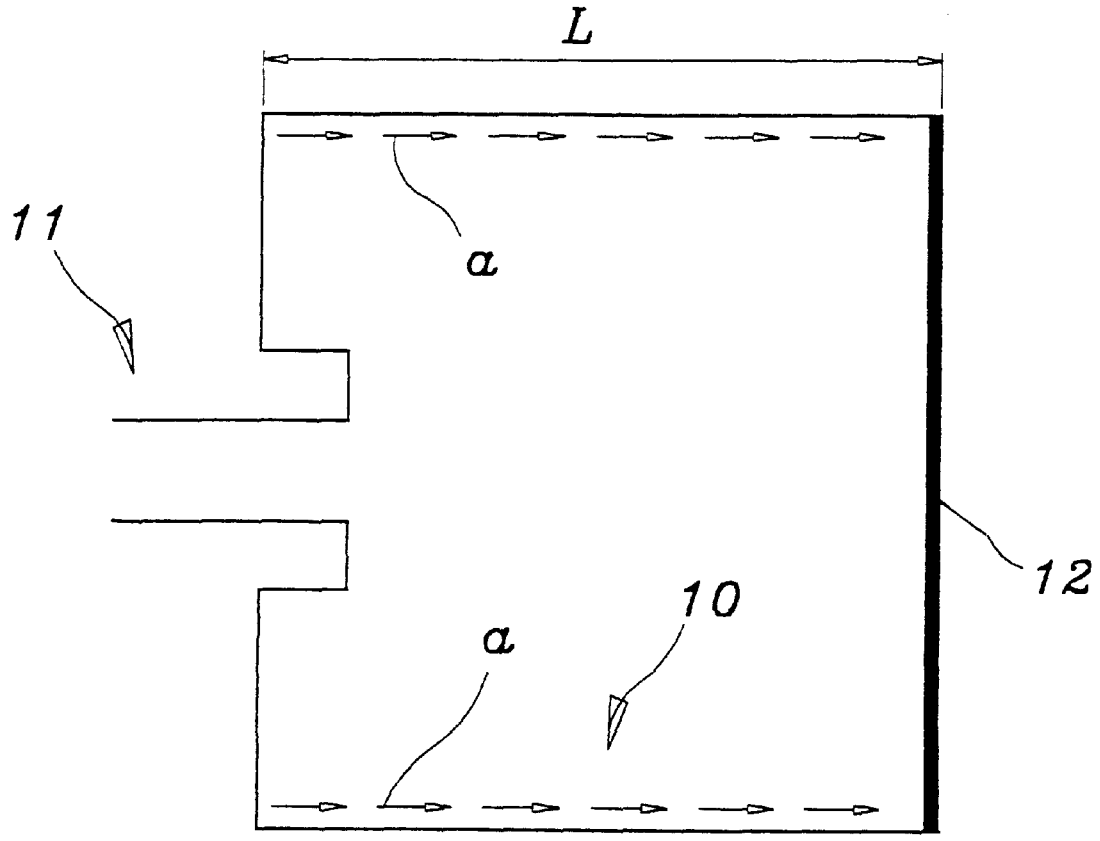
FIG. 5 PRIOR ART
FIG. 5 is a schematic view showing flowing of electric current of FIG. 1.
Figure 6:
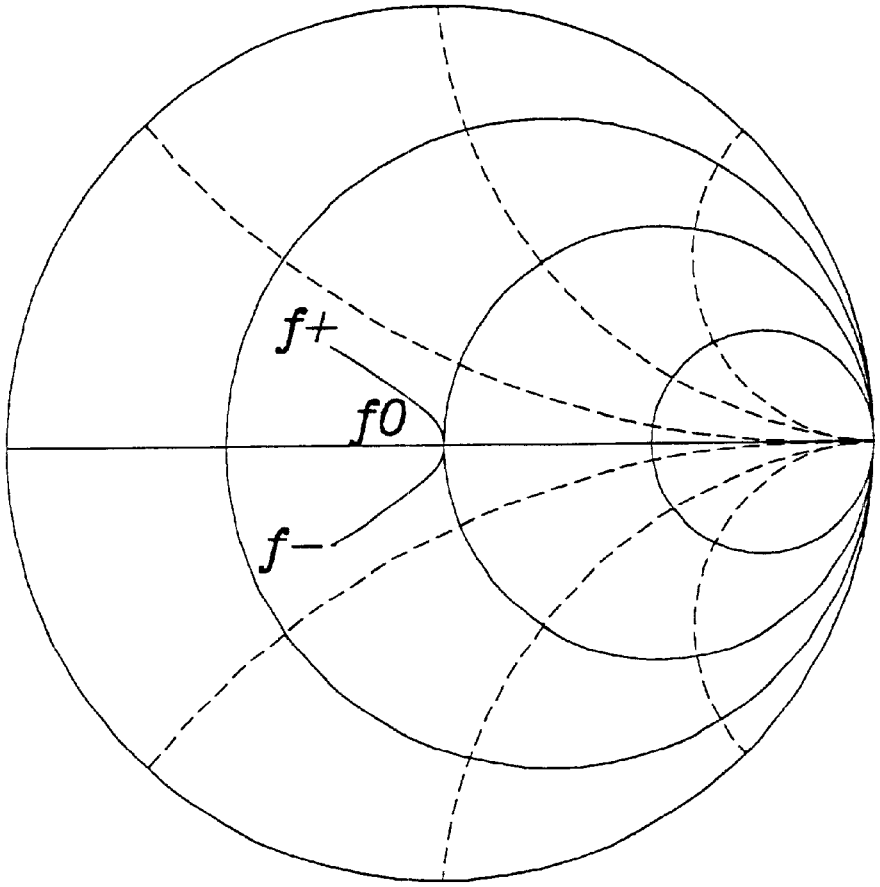
FIG. 6 PRIOR ART
FIG. 6 shows a Smith chart of the conventional circuit shorted resonant patch antenna.

As shown in FIG. 6, in the curve diagram of frequency of a conventional patch antenna as shown in this drawing, $f_O$ indicates the frequency at the center, f– indicates the frequency smaller than the central frequency, f+ indicates the frequency larger than the central frequency. By virtue that the lower portion of the Smith chart is capacitive, while the upper portion thereof is inductive, frequencies thereby are changing from those capacitive to those inductive. Therefore, a resonance circuit with a capacitor and an inductor can be used to compensate inductive low frequencies and capacitive high frequencies.

Based on this technique, the resonance circuit of the present invention can have a capacitor "C" and an inductor "L" parallelly connected with each other.

It is given that $$R = \frac{1}{jwc + \frac{1}{jwL}} = \frac{-j}{wc\left[1 - \frac{1}{w^2LC}\right]}$$

When (1)

$$w = \frac{1}{\sqrt{LC}}$$

R=∞,

When (2)

$$w > \frac{1}{\sqrt{LC}},$$

R<0, capacitive, when (3)

$$w < \frac{1}{\sqrt{LC}},$$

Figure 9:
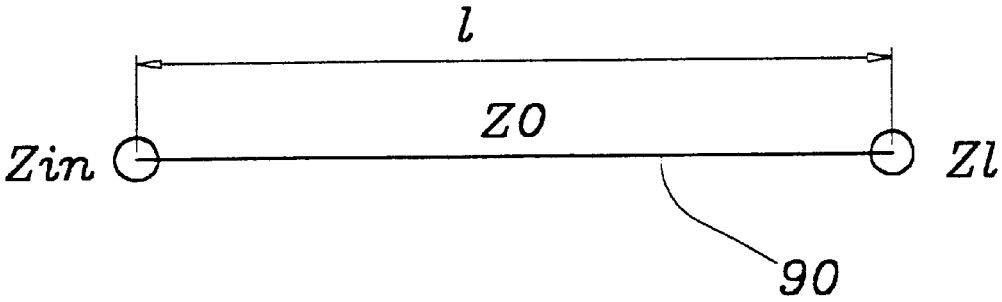
FIG. 9 is a schematic view showing using a transmission line in the present invention to form the desired function of a resonance circuit.

R>0, inductive,

The capacitor "C" and the inductor "L" in the above mentioned resonance circuit can both be substituted by a transmission line 90 (referring to FIG. 9).

As shown in FIG. 9, and according to the theory of transmission line, in the transmission line 90 of which the length is 1, the impedance on the line is $Z_0$, its input impedance is $Z_{in}$, while its load is $Z_L$, wherein:

$$Z_{in} = Z \cdot \frac{Z_L + jZ_o \tan\beta l}{Z_o + jZ_L \tan\beta l}$$

When $1 = \frac{1}{8}\lambda_g$, $$Z_{in} = Z_o \frac{Z_L + jZ_o}{Z_o + jZ_L},$$

wherein, $\lambda_g$ is the wavelength in the medium.

If (1) ZL=∞, it is an open circuit, then $Z_{in}$=–j $Z_0$, (2) ZL=0, it is a short circuit, then $Z_{in}$=$Z_0$.

Therefore, the transmission line 90 can be designed to be juxtaposed with the open circuit end 71 of the patch antenna 70. In the practicable embodiment, the upper end of the transmission line 90 is an open circuit end 91, while the lower end thereof is a short circuit 92.

The above stated technique of the present invention can shorten the set length of the resonant patch antenna to render miniaturization thereof feasible; hence it is industrial valuable.

The preferred embodiment disclosed above is only for illustrating the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

What is claimed is:

1. A broadband circuit shorted resonant patch antenna, said antenna comprising an open end and a short circuit end spaced apart by a length $L_1$, the open end having at least one open slot, the open end and the short circuit end having widths measured in a direction transverse to the length $L_1$, whereby the width of the short circuit end is less than the width of the open end so as to lengthen an electric current flowpath between the open end and the short circuit end.

2. The broadband circuit shorted resonant patch antenna as defined in claim 1, further comprising a resonance circuit.

3. The broadband circuit shorted resonant patch antenna as defined in claim 2, wherein, said resonance circuit comprises a capacitor and an inductor connected in parallel with each other.

4. The broadband circuit shorted resonant patch antenna as defined in claim 1, further comprising a transmission line connected to the antenna.

5. The broadband circuit shorted resonant patch antenna as defined in claim 4, wherein, said transmission line is juxtaposed with said open circuit end of said patch antenna.

* * * * *